United States Patent [19]

Morrison

[11] Patent Number: 4,832,525

[45] Date of Patent: May 23, 1989

[54] DOUBLE-BEARING SHAFT FOR A VIBRATING SCREED

[76] Inventor: Donald R. Morrison, 6228 Eagle Peak Dr., Charlotte, N.C. 28214

[21] Appl. No.: 173,121

[22] Filed: Mar. 25, 1988

[51] Int. Cl.[4] ..... E01C 19/38

[52] U.S. Cl. ..... 404/114; 404/119; 74/87; 384/901

[58] Field of Search ..... 404/102, 113, 114, 118–120; 74/61, 87; 425/456; 366/128; 384/416, 484, 587, 901

[56] References Cited

U.S. PATENT DOCUMENTS

| | | | |
|---|---|---|---|
| 1,943,076 | 1/1934 | Jackson | 404/114 X |
| 2,094,910 | 10/1937 | Baily | 404/114 X |
| 4,030,873 | 6/1977 | Morrison | 404/114 X |
| 4,213,749 | 7/1980 | Morrison | 404/119 X |
| 4,253,778 | 3/1981 | Morrison | 404/114 |
| 4,340,351 | 7/1982 | Owens | 425/456 |
| 4,386,901 | 6/1983 | Morrison | 404/119 X |
| 4,397,580 | 8/1983 | Morrison | 404/114 X |
| 4,397,626 | 8/1983 | Morrison | 404/114 X |
| 4,427,358 | 1/1984 | Stilwell | 404/119 X |
| 4,650,366 | 3/1987 | Morrison | 404/119 X |
| 4,701,071 | 10/1987 | Morrison | 404/119 X |
| 4,722,638 | 2/1988 | Morrison | 404/114 X |

*Primary Examiner*—Stephen J. Novosad
*Assistant Examiner*—John F. Letchford
*Attorney, Agent, or Firm*—Olive & Olive

[57] ABSTRACT

A portable vibrating screed includes a driven, vibratory rotatable shaft assembly mounted on an elongated frame equipped with means for screeding concrete. The shaft assembly includes a plurality of bearing assemblies spaced along the length of the shaft. Each bearing assembly includes a pair of separate bearing elements mounted on the shaft and supported in bearing supports secured to the frame. Failure of any single bearing element allows a companion bearing element in the same assembly to absorb all of the load imposed on such assembly to prevent shutdown and without impairing the needed vibration.

4 Claims, 3 Drawing Sheets

DOUBLE-BEARING SHAFT FOR A VIBRATING SCREED

BACKGROUND OF THE INVENTION

1. Field of the Invention

The present invention relates generally to concrete screeds. Specifically, the invention is concerned with a double-bearing shaft for a vibrating screed that is particularly suitable for a relatively small size, portable vibrating screed.

2. Description of the Related Art

Concrete floor and/or slab construction normally involves several steps, including pouring, compacting, puddling, screeding and surface finishing. A screed is run along the upper surface of the wet concrete to smooth and settle the concrete. Oftentimes, a screed includes a vibrating mechanism to expedite the settlement of the concrete.

Many job sites require relatively small size, lightweight and less expensive screeds that can be easily manuveured and operated. These small size vibrating screeds in some instances utilize different types of vibrating devices than larger and heavier screeds. The vibrating force for a lightweight screed is preferably uniformly spread along the length of the screed irrespective of where the vibration device is mounted on the screed. A relatively large size, portable vibrating screed with a semi-flexible shaft loosely supported in spaced apart single bearings is illustrated in U.S. Pat. No. 4,030,873. Examples of relatively small size, portable vibrating concrete screeds can be found in applicant's U.S. Pat. Nos. 4,386,901, 4,650,366 and 4,701,071.

A particular problem for relatively small size, portable vibrating screeds involves premature failure of bearings which loosely support a motor-driven rotating shaft as a vibrating device. Conventional rotating shafts include a plurality of single, relatively wide bearings loosely mounted on the shaft. Because of the vibrations and relatively heavy duty, the single bearings tend to wear out and fail prematurely, resulting in substantial maintenance expense and down time. A single bearing failure typically puts the entire small size screed machine out of service.

The art continues to seek improvements. It is desirable that bearings which loosely or otherwise support a vibrating rotating shaft in relatively small size portable screeds be able to withstand the vibrations transmitted to the shaft with minimum failure and down time.

SUMMARY OF THE INVENTION

The present invention relates to a vibrating shaft loosely supported on sets of uniquely mounted double bearings for imparting vibrations to a vibrating screed and to a screed employing such a shaft. The shaft is mounted within and rotates within a plurality of the uniquely mounted double-bearing assemblies which substantially extend the operating time of the screed as compared to a screed in which the shaft is mounted in single bearing assemblies. The double-bearing assemblies of the invention each include a pair of spaced apart, independently mounted, relatively narrow bearing elements which permit the semi-flexible shaft to flex between the bearing assemblies. The double bearing elements are preferably mounted loosely on the shaft and loosely within mating bearing housings or supports. However, the double bearing elements are also useful and substantially extend screed life when not loosely mounted on the shaft or within the bearing supports and employed with eccentric weights or the like on the shaft to impart vibration.

In a first preferred embodiment, a vibrating screed includes a driven rotatable shaft assembly mounted on a frame equipped with means for screeding the concrete. The shaft assembly includes a rotatable shaft having a plurality of the invention bearing assemblies. Each bearing assembly includes a pair of bearing elements separately mounted on the shaft. Pin screws retain the bearing elements on the shaft and the bearing assemblies spaced apart lengthwise along the shaft. Each bearing assembly is mounted in a bearing support on the frame assembly. Vibration is enhanced by mounting the bearing elements loosely on the shaft and by sizing the bearing supports so as to provide clearance for the bearing elements and thus a loose support within the bearing supports thereby further enhancing the vibration effect.

In a second preferred embodiment, the shaft assembly having the invention bearing assemblies is mounted within a tubular elongated section of a screed frame. Vibration is enhanced by sizing the inner diameter of the tubular section slightly larger than the diameter of the bearing elements so as to provide for clearance and a loose fit.

DETAILED DESCRIPTION OF THE PREFERRED EMBODIMENTS

Figure 1:
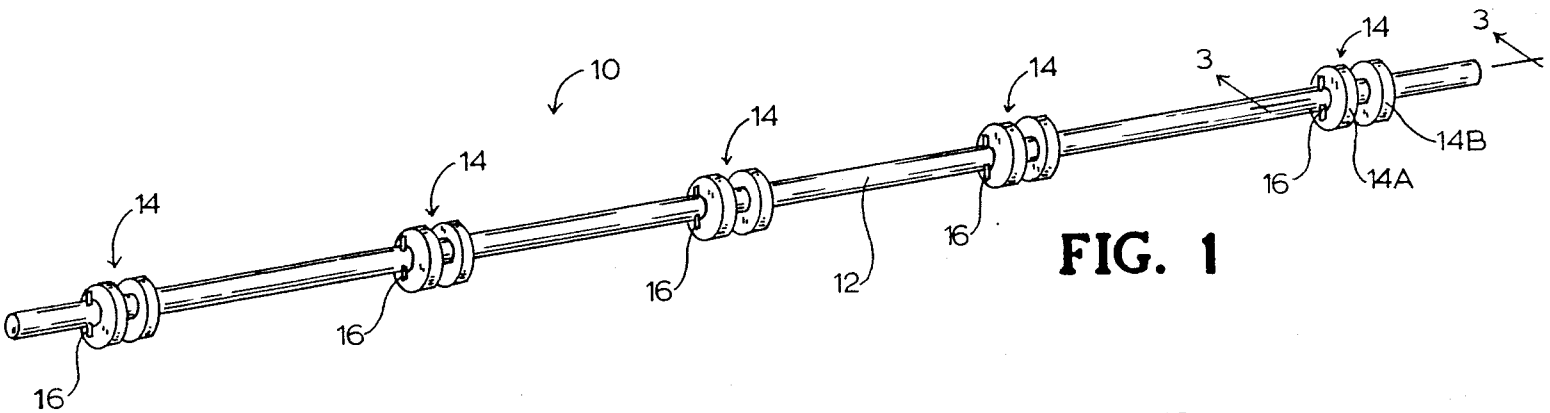
FIG. 1 is a perspective view of a preferred embodiment of a dismounted double-bearing shaft assembly for a vibrating screed.

A perspective view of a double-bearing shaft assembly according to the invention, indicated generally at 10, is illustrated in FIG. 1. The shaft assembly 10 includes a semi-flexible shaft 12 and a plurality of double bearing assemblies 14. For purposes of the drawings only, five bearing assemblies 14 are illustrated on the shaft 12 of FIG. 1.

Each bearing assembly 14 includes a first relatively narrow width bearing element 14A and a second relatively narrow width bearing element 14B. As illustrated best in FIG. 2, bearing elements 14A and 14B are spaced apart on the shaft 12. If desired, a spacer (not illustrated) can be inserted between bearing elements 14A and 14B to maintain a desired distance between the bearing elements 14A and 14B. Each bearing element 14A and 14B is constructed from a suitable conventional bearing, e.g., a sealed roller bearing. A pair of pin screws 16 are mounted on shaft 12 to retain bearing elements 14A and 14B. Pin screws 16 or other suitable retainers are mounted on shaft 12 in any desired manner. While not illustrated, shaft 12 is typically slightly bent to enhance the vibration. The invention construction both facilitates and reduces the amount of such bending. In one embodiment incorporated in the type of screed shown in the referenced U.S. Pat. No. 4,386,901, the bearing elements 14A, 14B were approximately 7/16" wide, 1 9/16" in diameter and were spaced apart about 5/16". Shaft 12 was ⅝" diameter steel.

Figure 3:
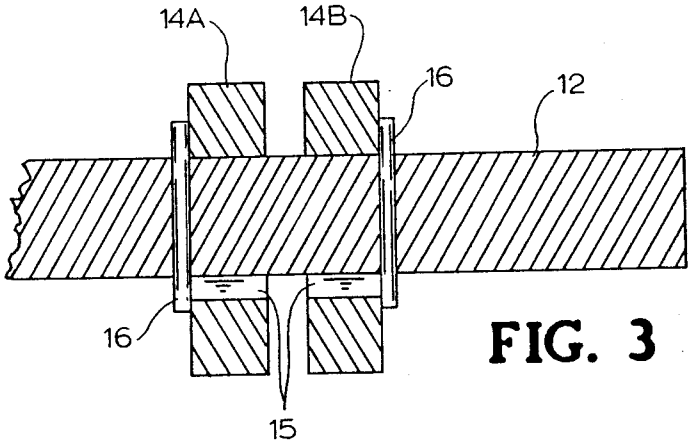
FIG. 3 is an enlarged sectional view of a double-bearing assembly taken along line 3—3 of FIG. 1 and with the bearing shaft clearance exaggerated for purposes of illustration.

As illustrated in FIG. 3, the shaft opening for each bearing element 14A and 14B is preferably larger than the diameter of shaft 12. A clearance 15 is thus provided between shaft 12 and bearing elements 14A and 14B. Because of clearance 15, bearing elements 14A and 14B are mounted loosely on shaft 12 and thereby permit vibration and play of shaft 12 as it is rotated. In a preferred embodiment, bearing elements 14A and 14B are mounted with a clearance 15 of, for example, twenty to sixty thousandths of an inch between shaft 12 and bearing elements 14A and 14B. Such clearance also facilitates slight bending of shaft 12 to enhance vibration while retaining the desired loose fit in both bearings of each set.

Figure 4:
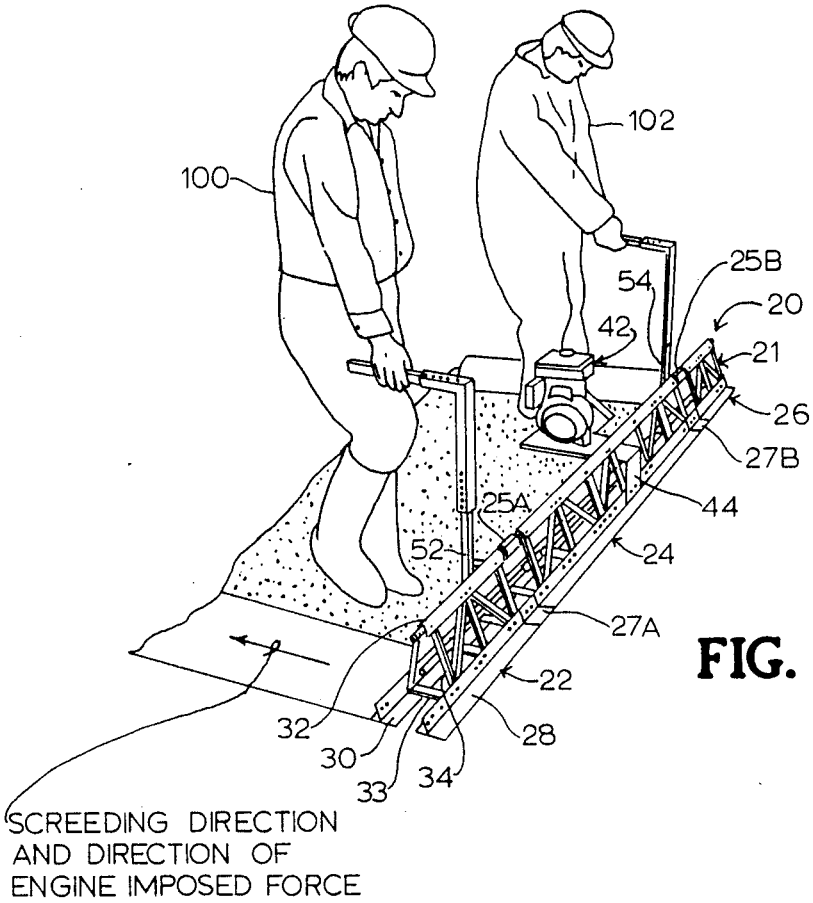
FIG. 4 is a perspective view of a first embodiment of a portable screed utilizing the shaft assembly of FIG. 1.

A screed 20 utilizing shaft assembly 10 is illustrated in FIG. 4. The shaft assembly 10 is particularly adaptable for use with applicants' portable vibrating concrete screed disclosed in U.S. Pat. No. 4,386,901 the description of which is hereby incorporated by reference.

Screed 20 is illustrated as being formed of three separate frame sections 22, 24 and 26. Frame sections 22 and 24 are removably connected by turnbuckle nut 25A and plates 27A. Frame sections 24 and 26 are removably connected by turnbuckle nut 25B and plates 27B. It will be understood that the frame sections 22, 24 and 26 can be formed as a unitary member or as a plurality of sections as desired.

It is preferred that in the illustrated embodiment screed 20 have a frame 21 of triangular cross section formed by screed blades 28 and 30 and ridge member 32. A plurality of frame supports 33 are connected between screed blades 28 and 30. A plurality of braces 34 are connected between the screed blades 28 and 30 and the ridge member 32.

Screed 20 includes bearing supports 35 formed as castings which transversely bridge the distance between screed blades 28 and 30. Castings 35 are connected to screed blades 28 and 30 by bolts or other suitable means. Each casting 35 is shaped to receive both elements of a double bearing assembly 14 of shaft assembly 10. Castings 35 are preferably formed with bearing support inner diameters slightly larger than the outer diameters of bearing assemblies 14 and may, for example, provide a clearance 36 (FIG. 2) of between twenty to sixty thousands of an inch. Such clearance provides a loose fit between the support surfaces of castings 35 and bearing elements 14A and 14B to enhance vibration and play of bearing elements 14A and 14B as shaft 12 is rotated.

Figure 5:
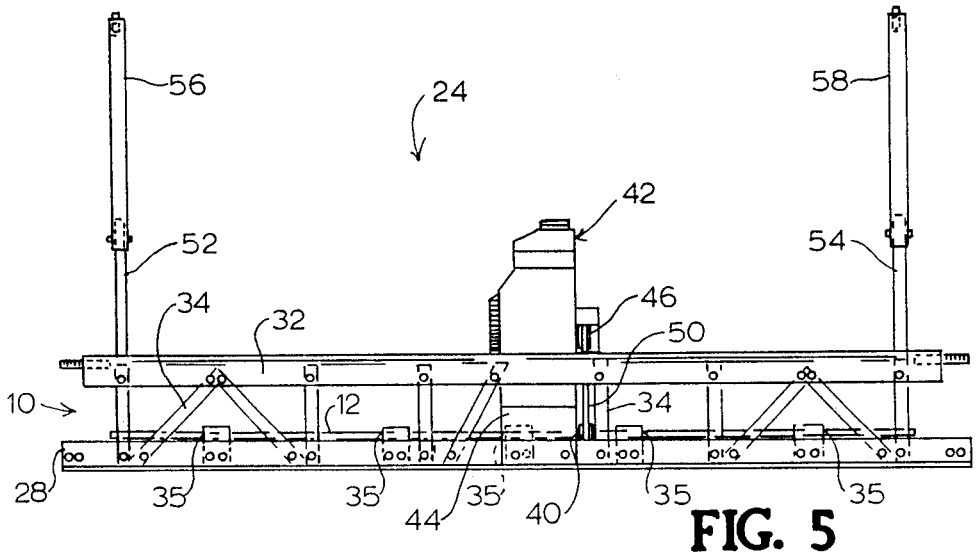
FIG. 5 is a rear elevational view of the central frame section of the screed of FIG. 4.
Figure 6:
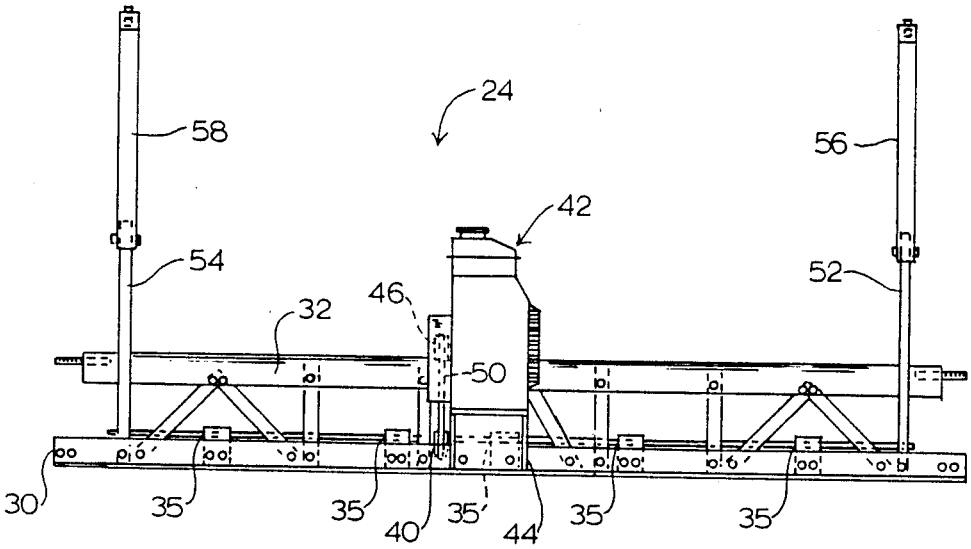
FIG. 6 is a front elevational view of the central frame section of FIG. 5.

A pulley 40 is mounted on shaft 12 at a selected position between bearing assemblies 14. A variable speed drive source 42, illustrated as a lightweight engine in FIGS. 4-6, is mounted on screed 20 by engine mount 44. Engine mount 44 is mounted on frame 21 by any suitable means.

A drive pulley 46 is fixed on the shaft of engine 42 and drives a belt 50 which in turn drives pulley 40. Shaft 12 rotates in a counter-clockwise direction as viewed in FIG. 4 as indicated by arrow C in FIG. 4 and the shaft vibration tends to cause screed 20 to creep in the forward direction. This movement substantially reduces the force required to move the screed 20 over the concrete.

To facilitate movement of the screed 20, a pair of vertical posts 52 and 54, mounted to frame 21, mount telescoping L-shaped handles 56 and 58. Handles 56 and 58 permit operators 100 and 102 to move the screed 20 over the surface of the concrete.

Figure 7:
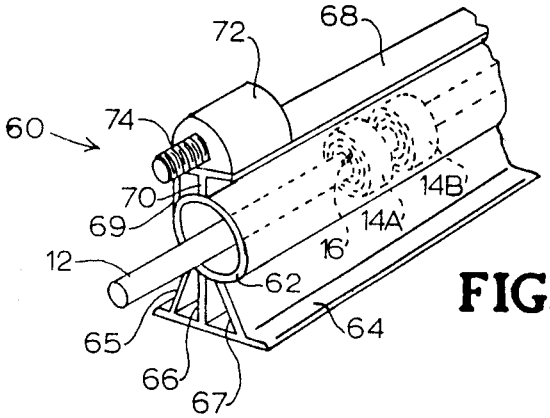
FIG. 7 is a partial perspective view of a second embodiment of a portable screed frame section utilizing the shaft assembly of FIG. 1.

A second embodiment of a portable screed frame section, indicated generally at 60, is illustrated in FIG. 7. Screed frame section 60 includes a tubular section 62 joined to a bottom screeding plate 64 by a set of lower ribs 65, 66 and 67. A top flat plate 68 is joined to tubular section 62 by a set of upper ribs 69 and 70. A support 72 and threaded rod 74, mounted on the top flat plate 68, are used with conventional turnbuckle nuts (not illustrated) to connect frame sections of a screed. A portable screed having a frame section of the type of screed frame section 60 is disclosed in applicant's U.S. Pat. No. 4,701,071 which is hereby incorporated by reference. The applicant's portable vibrating concrete screed disclosed in U.S. Pat. No. 4,701,071 is particularly adaptable for use with shaft assembly 10.

Figure 2:
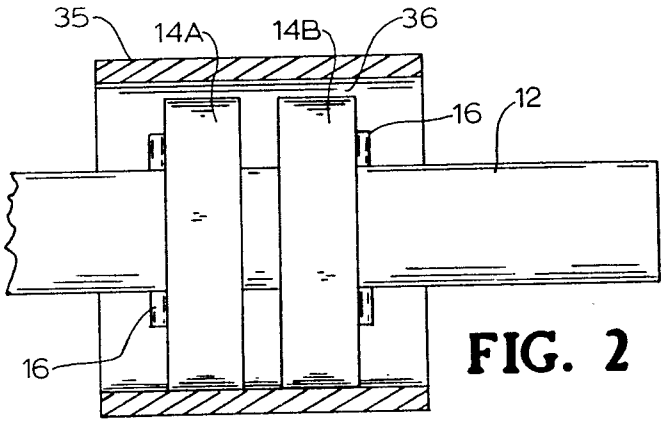
FIG. 2 is an enlarged elevational view of a double-bearing assembly for the shaft assembly of FIG. 1 and with the bearing housing clearance exaggerated for purpose of illustration.

Shaft assembly 10 is inserted into tubular section 62. The inner diameter of tubular section 62 is preferably slightly larger than the outer diameter of bearing elements 14A and 14B to provide a clearance similar to clearance 36 provided between bearing elements 14A and 14B and castings 35 (FIG. 2). Such a clearance, in combination with clearance 15 between bearing elements 14A and 14B and shaft 12 (FIG. 3), provides a loose fit of shaft assembly 10 in tubular section 62 to enhance vibration and play of shaft assembly 10 as it is rotated by suitable means. The clearance between the bearing elements 14A and 14B and tubular section 62 can range, for example, between twenty and sixty thousandths of an inch.

Each bearing element 14A or 14B of each bearing assembly 14 is sized and selected with a load carrying capability of performing independently of the other bearing element 14A or 14B. Such capability thus permits continued operation of the screed 20 when one bearing element 14A or 14B in a particular assembly 14 fails. In other words, if bearing element 14A fails, bearing element 14B of the same assembly 14 provides the load carrying requirement of the assembly 14 to keep the screed 20 in operation until the job is finished at which time all necessary repairs can be made without having to stop work on the job because of a single bearing failure. It has also been observed that the double-bearing assemblies 14 each of which is made up of a pair of single width bearings each operating independent of the other tends to eliminate or at least substantially reduce casting 35 failures which typically occur when a single bearing fails. Enhanced vibration is also obtained since each bearing in each assembly is free to vibrate independent of the other bearing in the same assembly.

As previously mentioned, another discovered advantage of the double-bearing shaft assembly 10 is that less bend is required in shaft 12 than in single-bearing shaft assemblies in order to obtain the same vibrating effect in the shaft 12 when rotated.

While the double bearing assemblies of the invention are preferably loosely mounted as described many advantages of the invention are derived when the bearings are snugly mounted on the shaft and in th bearing housings with eccentric weights, shaft bend or the like employed to impart vibration.

Although the present invention has been described with reference to preferred embodiments, workers skilled in the art will recognize that changes may be made in form and detail without departing from the spirit and scope of the invention.

What is claimed is:

1. A portable screed comprising:

(a) an elongated light-weight portable frame with screeding means extending along the length and bottom thereof for engaging and leveling concrete;

(b) a rotatable semi-flexible shaft mounted immediately above and between the outer extremities of said screening means;

(c) a plurality of bearing assemblies mounted on and at spaced intervals along the length of said shaft, each bearing assembly comprising a pair of separate, spaced-apart, bearing elements, each bearing element being capable of carrying the load of the assembly of which it forms a part and said shaft being loosely supported in each of said bearing elements;

(d) means secured to the shaft for retaining said bearing elements and bearing assemblies in their respective positions along the length of said shaft;

(e) bearing support means supported by said frame and loosely supporting each of the bearing elements of said assemblies; and (f) drive means mounted on said frame and connected to drive said shaft at sufficient speed to cause said loosely mounted shaft and pairs of elements to vibrate said screeding means and thereby vibrate said concrete.

2. A portable screed as claimed in claim 1 having a clearance of between twenty and sixty thousands of an inch provided between each bearing element and said shaft and between each bearing element and its respective said bearing support.

3. A portable screed as claimed in claim 1 wherein said frame is of triangular cross section, said screeding means comprises a pair of spaced-apart screed plates and said bearing support means comprise a plurality of spaced-apart bearing supports mounted within said frame.

4. A portable screed as claimed in claim 1 wherein said frame includes an elongated tubular portion, said screeding means is formed integral with said tubular portion, said bearing assemblies are loosely mounted within said tubular portion and said tubular portion serves as said bearing support means.

* * * * *

UNITED STATES PATENT AND TRADEMARK OFFICE

CERTIFICATE OF CORRECTION

PATENT NO. : 4,832,525

DATED : May 23, 1989

INVENTOR(S) : Donald R. Morrison

It is certified that error appears in the above-identified patent and that said Letters Patent is hereby corrected as shown below:

Column 4, line 68, correct "th" to read --the--.

Column 5, line 15, correct "screening" to read --screeding--.

Signed and Sealed this

Twenty-eighth Day of November 1989

*Attest:*

JEFFREY M. SAMUELS

*Attesting Officer* *Acting Commissioner of Patents and Trademarks*